US005728233A

United States Patent [19]

Ikeda et al.

[11] Patent Number: 5,728,233

[45] Date of Patent: Mar. 17, 1998

[54] SURFACE TREATMENT COMPOSITION, SURFACE TREATMENT SOLUTION AND SURFACE TREATMENT METHOD FOR ALUMINUM AND ITS ALLOYS

[75] Inventors: Satoshi Ikeda, Tokyo; Masayuki Kamimura, Chiba, both of Japan

[73] Assignee: Nippon Paint Co., Ltd., Osaka, Japan

[21] Appl. No.: 751,726

[22] Filed: Nov. 18, 1996

[30] Foreign Application Priority Data

Nov. 20, 1995 [JP] Japan ..... 7-301309

[51] Int. Cl.[6] ..... C23C 22/00

[52] U.S. Cl. ..... 148/247

[58] Field of Search ..... 148/247

[56] References Cited

U.S. PATENT DOCUMENTS

| | | | |
|---|---|---|---|
| 4,148,670 | 4/1979 | Kelly | 148/6.15 |
| 4,264,378 | 4/1981 | Oppen et al. . | |
| 5,449,415 | 9/1995 | Dolan . | |

FOREIGN PATENT DOCUMENTS

| | | | |
|---|---|---|---|
| 0015020 | 9/1980 | European Pat. Off. . | |
| 1172741 | 2/1959 | France . | |
| 57-39314 | 8/1982 | Japan | C23F 7/14 |
| 2250025 | 5/1992 | United Kingdom . | |
| 9504169 | 2/1995 | WIPO . | |

*Primary Examiner*—Sam Silverberg

*Attorney, Agent, or Firm*—Sughrue, Mion, Zinn, Macpeak & Seas, PLLC

[57] ABSTRACT

A highly uniform thin protective coating, with good appearance, anti-corrosion properties and adhesion properties, is provided by a surface treatment method wherein a surface treatment solution for aluminum and its alloys is prepared using a surface treatment composition for aluminum and its alloys comprising at least one type of phosphoric acid, condensed phosphoric acid or salt of these acids, at least one type of zirconium salt or titanium salt and effective fluoride, further comprising at least one type of phosphorous acid, hypophosphorous acid or salts of these acids, and this solution is brought in contact with the surface of an aluminum type metal.

3 Claims, 2 Drawing Sheets

SURFACE TREATMENT COMPOSITION, SURFACE TREATMENT SOLUTION AND SURFACE TREATMENT METHOD FOR ALUMINUM AND ITS ALLOYS

BACKGROUND OF THE INVENTION

1. Field of the Invention

This invention relates to a surface treatment composition for aluminum and its alloys, treatment solution and treatment method for aluminum and its alloys, and in particular, to a surface treatment composition, treatment solution and treatment method for aluminum and its alloys which forms a highly uniform thin coating, and provides a protective coating having a good appearance, corrosion resistance and paint adhesion.

2. Description of the Related Arts

Conventionally, aluminum and aluminum alloy surfaces were given with a chromate treatment or an alumite treatment. However, chromate treatment causes environmental pollution, is toxic to human health and generates waste sludge which cannot be disposed easily. On the other hand, alumite treatment requires heavy equipment, consumes much electric power and is uneconomical.

Various non-chromate treatment methods have been proposed to resolve these problems. For example, U.S. Pat. No. 4,148,670, entitled "Aqueous acidic conversion coating solution for aluminum" proposes acidic aqueous coatings solutions containing zirconium, titanium or mixtures of same, containing phosphates and fluorides, and having a pH within the range of approx. 1.5 –approx. 5.4.

Further, Japanese Patent Publication No. Sho 57-39314, entitled "Aluminum Surface Treatment Method", proposes a surface treatment for aluminum and its alloys using acidic aqueous solutions containing one, two or more titanium salts or zirconium salts having a concentration of 0.01–10 g/l as the metal, a peroxide concentration of 0.005–5 g/l, and one, two or more phosphoric acids or condensed phosphoric acids having a concentration of 0.05–20 g/l as phosphoric acid, these substances being present in a weight ratio of 1–10:0.1–10:1.5–30.

The aforesaid U.S. Pat. No. 4,148,670, "Aqueous acidic conversion coating solution for aluminum" and Japanese Patent Publication No. Sho 57-39314, "Aluminum Surface Treatment Method", may be used to form a protective coating on the surface of for example beverage containers made of aluminum or aluminum alloy.

Normally, beverage containers made of aluminum or aluminum alloy are manufactured by a processing technique known as drawing and ironing (DI process). During the processing operation, lubricating oil is applied to the metal surface, and aluminum powder (smat) is formed to adhere to the inner wall of the formed container. Therefore in general, prior to chemical treatment, the lubricating oil or smat must be removed from the metal surface, and after cleaning, the metal surface of the container is protected by the chemical treatment and coating.

In recent years, to reduce costs, there has been a trend to reduce the outer diameter of can lids from 206 (6.0 cm) to 204 (approx. 5.7 cm) and 202 (approx. 5.4 cm). The diameter of the upper part of the container must therefore also be reduced, and "necking" of the upper parts of cans after coating is now becoming an increasingly important issue. Therefore, higher paint adhesion is required for those cans of smaller diameter.

In the surface treatment solution used in the aforesaid Japanese Patent Publication No. Sho 57-39314, "Aluminum Surface Treatment Method", of the prior art, no attempt is made to remove the oxide film which forms on the metal surface by adding a certain chemicals, hence the chemical coating is formed over the oxide layer. The chemical coating is therefore formed unevenly over the oxide layer, and if it is attempted to give the can sufficient anti-corrosion properties such as resistance to boiling water or steam resistance properties (anti-retort properties), the thickness of the chemical coating must be increased. However when the thickness of the chemical coating is increased, adhesion between the coating and metal surface during the necking process, i.e. the paint adhesion, becomes insufficient. On the other hand, when it is attempted to provide sufficient paint adhesion by making the chemical coating thin, since the coating is uneven, the required anti-corrosion properties are not obtained.

The fluoride described in the aforesaid U.S. Pat. No. 4,148,670, "Aqueous acidic conversion coating solution for aluminum", etches the oxide layer on the metal surface and thereby removes it, however as there is no chemical to take up the oxygen in the oxide layer, the metal surface reoxidizes. The chemical coating is therefore once again formed over the oxide layer, and the coating is uneven as a result. If it is attempted to obtain corrosion resistance when the chemical coating is not sufficiently uniform, the chemical coating must be formed thicker and its adhesion becomes therefore poor. In order to achieve sufficient paint adhesion, the chemical coating must be made thinner, however as the coating is then uneven, its corrosion resistance is inadequate.

In other words, using the conventional surface treatment method, it was difficult to achieve the dual objectives of corrosion resistance and paint adhesion in the case of low diameter cans.

DESCRIPTION OF THE PRESENT INVENTION

It is therefore an object of this invention to provide a surface treatment composition, treatment solution and treatment method for aluminum and its alloys, which forms a highly uniform thin coating, and provides a protective coating having a good appearance, corrosion resistance and paint adhesion.

To achieve the above objects, the surface treatment composition for aluminum and its alloys according to this invention comprises at least one type of phosphoric acid, condensed phosphoric acid or salt of these acids, at least one type of zirconium salt or titanium salt and a fluoride, further comprising at least one type of phosphorus acid, hypophosphorous acid or salt of these acids.

When a treatment solution is prepared by diluting the surface treatment composition for aluminum and its alloys with a suitable quantity of water so as to obtain a concentration within usable limits, and a chemical coating is formed (i.e. a surface treatment is performed) by this solution on a metal surface, the fluoride in the composition of this invention etches the oxide layer on the metal surface and thereby removes it from the surface. The phosphorous acid, hypophosphorous acid or salts of these acids in the composition of this invention act as reaction promoters. It is thought that they function as reducing agents which prevent oxidation of the bare aluminum surface. Due to the action of the zirconium salts and/or titanium salts, fluorides, phosphoric acids and/or condensed phosphoric acids, and phosphorous acids and/or hypophosphorous acids, a complex salt is formed due to which a strong coating is formed on the metal surface.

PREFERRED FORMS OF THE INVENTION

The surface treatment composition for aluminum and its alloys of this invention comprises at least one type of phosphoric acid, condensed phosphoric acid or salt of these acids, at least one type of zirconium salt or titanium salt and a fluoride, further comprising at least one type of phosphorus acid ($H_2PHO_3$), hypophosphorous acid ($HPH_2O_2$) or salt of these acids.

Examples of phosphoric acid or phosphates are $H_3PO_4$, $(NH_4)H_2PO_4$, alkali metal phosphates such as $NaH_2PO_4$, $KH_2PO_4$, and alkaline earth metal phosphates such as calcium phosphate or magnesium phosphate. Examples of condensed phosphoric acids are pyrophosphoric acid, tripolyphosphoric acid, metaphosphoric acid or ultraphosphoric acid, and examples of condensed phosphates are alkali metal salts such as those of sodium or potassium, alkaline earth metal salts such as those of calcium or magnesium, and ammonium salts.

Examples of zirconium salts are zirconium hydrofluoric acid ($H_2ZrF_6$) and lithium, sodium, potassium or ammonium salts of fluorozirconium acid ($Li_2ZrF_6$, $Na_2ZrF_6$, $K_2ZrF_6$, $(NH_4)_2ZrF_6$), zirconium sulfate ($Zr(SO_4)_2$), zirconyl sulfate ($ZrO(S0_4)$, zirconium nitrate ($Zr(NO_3)_4$, zirconyl nitrate ($ZrO(NO_3)_2$, zirconium acetate or zirconium fluoride ($ZrF_4$).

Examples of titanium salts are titanium hydrofluoric acid ($H_2ZrF_6$) and lithium, sodium, potassium or ammonium salts of fluorotitanium acid ($Li_2TiF_6$, $Na_2TiF_6$, $K_2TiF_6$, $(NH_4)_2TiF_6$), titanium sulfate ($Ti(SO_4)_2$), titanyl sulfate ($TiO(SO_4)$, titanium nitrate ($Ti(NO_3)_4$, titanyl nitrate ($TiO(NO_3)_2$, or titanium fluoride ( $TiF_3.TiF_4$).

Examples of fluorides are hydrofluoric acid (HF), ammonium fluoride ($NH_4F$), ammonium hydrofluoride ($NH_4HF_2$), sodium fluoride (NaF) and sodium hydrogen fluoride ($NaHF_2$).

Examples of phosphites and hypophosphites are alkali metal salts such as those of sodium or potassium, alkaline earth metal salts such as those of calcium or magnesium, and ammonium salts.

The surface treatment solution for aluminum and its alloys is obtained by diluting the aforesaid surface treatment composition with a suitable quantity of water so as to obtain a concentration within usable limits. The following description is based on this surface treatment solution (referred to hereafter simply as "treatment solution").

In a treatment solution according to this form of the invention, phosphoric acids, condensed phosphoric acids or salts of these acids, have a concentration of at least 10 ppm, preferably 10–500 ppm and more preferably 10–100 ppm expressed as $PO_4$. When at least one type of phosphoric acids, condensed phosphoric acids or salts of these acids have a concentration in the treatment solution of less than 10 ppm expressed as $PO_4$, blackening occurs on contact with boiling water. When on the other hand, phosphoric acids are excessive, not only does blackening occur on contact with boiling water but also the paint adhesion becomes poorer, hence it is desirable that their concentration is within 500 ppm as $PO_4$.

In a treatment solution according to this invention, zirconium salts or titanium salts of which at least one type is present, have a concentration of at least 10 ppm, preferably 10–500 ppm and more preferably 10–100 ppm as the metal. When at least one type of zirconium salts or titanium salts have a concentration in the treatment solution of less than 10 ppm, the chemical coating is hardly formed. When on the other hand, zirconium salts, etc. are added in excess, an enhanced effect is not obtained, hence it is desirable that their concentration is within 500 ppm as the metal.

In a treatment solution according to this invention, effective fluorides have a concentration of at least 1 ppm and preferably 3–50 ppm as fluorine. When, in a treatment solution according to this invention, effective fluorides have a concentration of less than 1 ppm as fluorine, almost no etching of the aluminum surface occurs, so the adhesion between the surface of the aluminum and aluminum alloys and the coating deteriorates. When on the other hand, the fluoride content is excessive, the rate of etching is faster than that of coating formation so that it is difficult to form the coating, in addition to which blackening on contact with boiling water is worse and the paint adhesion deteriorates. It is therefore desirable that the concentration of fluorides is within 50 ppm as fluoride.

Herein, the term "effective fluoride" refers to a fluoride which releases fluoride ion in the treatment solution, the free fluoride ion ($F^-$) in the solution hereafter being referred to as "effective fluoride ion". The concentration of this effective fluoride ion is found by measuring the solution using a meter having a fluoride ion electrode. Effective fluoride ion, in addition to etching the oxide layer on the aluminum surface, stops or prevents zirconium and/or titanium phosphate precipitates from forming in the treatment solution. It also complexes aluminum that has dissolved in the solution during surface treatment so that it does not have an adverse effect on the surface treatment process.

In a treatment solution according to this invention, phosphorous acids, hypophosphorous acids or salts of these acids, of which at least one type is present, have a concentration in the treatment solution of at least 10 ppm, preferably 10–5000 ppm and more preferably 50–500 ppm as $PO_3$ or hypophosphorous acid. When, in a treatment solution according to this invention, at least one type of phosphorous acids, hypophosphorous acids or salts of these acids have a concentration of less than 10 ppm as $PO_3$ of hypophosphorous acid, the chemical coating is not sufficiently uniform. When on the other hand, the concentration of phosphorous acids or hypophosphorous acid in the solution exceeds 5000 ppm as $PO_3$, the paint adhesion deteriorates.

Materials suitable for treatment by the surface treatment composition or treatment solution according to this invention, are aluminum and/or aluminum alloys. Examples of aluminum and/or aluminum alloys are aluminum, aluminum-copper, aluminum-zinc, aluminum-manganese, aluminum-magnesium, aluminum-magnesium-silicon or aluminum-zinc-magnesium. The invention may be applied to these materials in the form of sheet, rod, wire or pipe, or to beverage cans or the like.

A treatment solution in this invention is acidic. The pH of the treatment solution lies in the range 1.5–4.0, but more preferably 2.0–3.5. When the pH of the treatment solution is less than 1.5, etching is too severe, it is difficult to form the coating, blackening on contact with boiling water is worse and paint adhesion deteriorates. When on the other hand the pH of the treatment solution exceeds 4.0, the treatment solution becomes turbid and sludge forms. Moreover as the coating is hardly formed, blackening on contact with boiling water is worse.

The treatment temperature of the surface treatment method (referred to hereafter simply as "treatment method") lies in the range of room temperature –60° C., but preferably 30°–50° C. When the treatment temperature is lower than room temperature (e.g. 25° C.), the coating forms slowly. When the treatment temperature exceeds 60° C., the treatment solution becomes turbid and sludge tends to form. Further, as a large quantity of energy is required to maintain the temperature, it is uneconomical.

The treatment time of the method according to this invention varies depending on the treatment composition, treatment temperature and treatment method, but it is generally of the order of 5–60 seconds. As examples of treatment methods according to this invention, aluminum products or the like may be immersed in the aforesaid treatment solution, or any method known in the art may be used such as spraying or coating the aforesaid treatment solution onto the aluminum products or the like.

Other preferred forms of the invention are described below.

(1) A surface treatment solution for aluminum and its alloys comprising:
- phosphoric acids, condensed phosphoric acids or salts of these acids, of which at least one type is present, having a concentration of 10–500 ppm as $PO_4$,
- zirconium salts or titanium salts of which at least one type is present, having a concentration of 10–500 ppm as the metal,
- effective fluorides having a concentration of 1–50 ppm as fluorine, and phosphorous acids, hypophosphorous acids or salts of these acids, of which at least one type is present, having a concentration of 10–500 ppm as $PO_3$ or hypophosphorous acid.

(2) A surface treatment solution for aluminum and its alloys comprising:
- phosphoric acids, condensed phosphoric acids or salts of these acids, of which at least one type is present, having a concentration of 10–100 ppm as $PO_4$,
- zirconium salts or titanium salts of which at least one type is present, having a concentration of 10–100 ppm as the metal,
- effective fluorides having a concentration of 3–50 ppm as fluorine, and
- phosphorous acids, hypophosphorous acids or salts of these acids, of which at least one type is present, having a concentration of 50–500 ppm as $PO_3$ or hypophosphorous acid.

(3) A surface treatment solution for aluminum and its alloys comprising:
- phosphoric acids, condensed phosphoric acids or salts of these acids, of which at least one type is present, having a concentration of 10–100 ppm as $PO_4$,
- zirconium salts or titanium salts of which at least one type is present, having a concentration of 10–100 ppm as the metal,
- effective fluorides having a concentration of 3–20 ppm as fluorine, and
- phosphorous acids, hypophosphorous acids or salts of these acids, of which at least one type is present, having a concentration of 50–500 ppm as $PO_3$ or hypophosphorous acid.

(4) A surface treatment method for aluminum and its alloys, wherein aluminum products are immersed in a surface treatment solution for aluminum and its alloys comprising:
- phosphoric acids, condensed phosphoric acids or salts of these acids, of which at least one type is present, having a concentration of at least 10 ppm as $PO_4$,
- zirconium salts or titanium salts of which at least one type is present, having a concentration of at least 10 ppm as the metal,
- effective fluorides having a concentration of at least 1 ppm as fluorine, and
- phosphorous acids, hypophosphorous acids or salts of these acids, of which at least one type is present, having a concentration of at least 10 ppm as $PO_3$ or hypophosphorous acid.

(5) A surface treatment method for aluminum and its alloys, wherein aluminum products are immersed in a surface treatment solution for aluminum and its alloys comprising:
- phosphoric acids, condensed phosphoric acids or salts of these acids, of which at least one type is present, having a concentration of 10–500 ppm as $PO_4$,
- zirconium salts or titanium salts of which at least one type is present, having a concentration of 10–500 ppm as the metal,
- effective fluorides having a concentration of 1–50 ppm as fluorine, and
- phosphorous acids, hypophosphorous acids or salts of these acids, of which at least one type is present, having a concentration of 10–5000 ppm as $PO_3$ or hypophosphorous acid.

(6) A surface treatment method for aluminum and its alloys, wherein aluminum products are immersed in a surface treatment solution for aluminum and its alloys comprising:
- phosphoric acids, condensed phosphoric acids or salts of these acids, of which at least one type is present, having a concentration of 10–100 ppm as $PO_4$,
- zirconium salts or titanium salts of which at least one type is present, having a concentration of 10–100 ppm as the metal,
- effective fluorides having a concentration of 3–50 ppm as fluorine, and
- phosphorous acids, hypophosphorous acids or salts of these acids, of which at least one type is present, having a concentration of 50–500 ppm as $PO_3$ or hypophosphorous acid.

(7) A surface treatment method for aluminum and its alloys, wherein aluminum products are immersed in a surface treatment solution for aluminum and its alloys comprising:
- phosphoric acids, condensed phosphoric acids or salts of these acids, of which at least one type is present, having a concentration of 10–100 ppm as $PO_4$,
- zirconium salts or titanium salts of which at least one type is present, having a concentration of 10–100 ppm as the metal,
- effective fluorides having a concentration of 3–20 ppm as fluorine, and
- phosphorous acids, hypophosphorous acids or salts of these acids, of which at least one type is present, having a concentration of 50–500 ppm as $PO_3$ or hypophosphorous acid.

(8) A surface treatment solution for aluminum and its alloys according to this invention of which the pH lies in the range 1.5–4.0.

(9) A surface treatment solution for aluminum and its alloys used in the surface treatment method according to this invention, wherein the pH of the solution lies in the range of 1.5–4.0.

(10) An aluminum product that has been immersed in a surface treatment solution for aluminum and its alloys according to this invention.

(11) An aluminum beverage container that has been immersed in a surface treatment solution for aluminum and its alloys according to this invention.

(12) An aluminum product that has been treated by the surface treatment method for aluminum and its alloys according to this invention.

(13) An aluminum beverage container that has been treated by the surface treatment method for aluminum and its alloys according to this invention.

(14) A surface treatment method for aluminum and its alloys according to this invention, wherein the treatment temperature lies in the range of room temperature –60° C.

(15) A surface treatment method for aluminum and its alloys, wherein an aluminum product is immersed in a surface treatment solution for aluminum and its alloys comprising:

phosphoric acids, condensed phosphoric acids or salts of these acids, of which at least one type is present, having a concentration of 10–100 ppm as $PO_4$, zirconium fluoride having a concentration of 10–100 ppm as the Zr metal, effective fluorides having a concentration of 3–20 ppm as fluorine, and phosphorous acids, hypophosphorous acids or salts of these acids, of which at least one type is present, having a concentration of 50–500 ppm as $PO_3$ or hypophosphorous acid.

DESCRIPTION OF THE ACTUAL EXAMPLES

Figure 1:
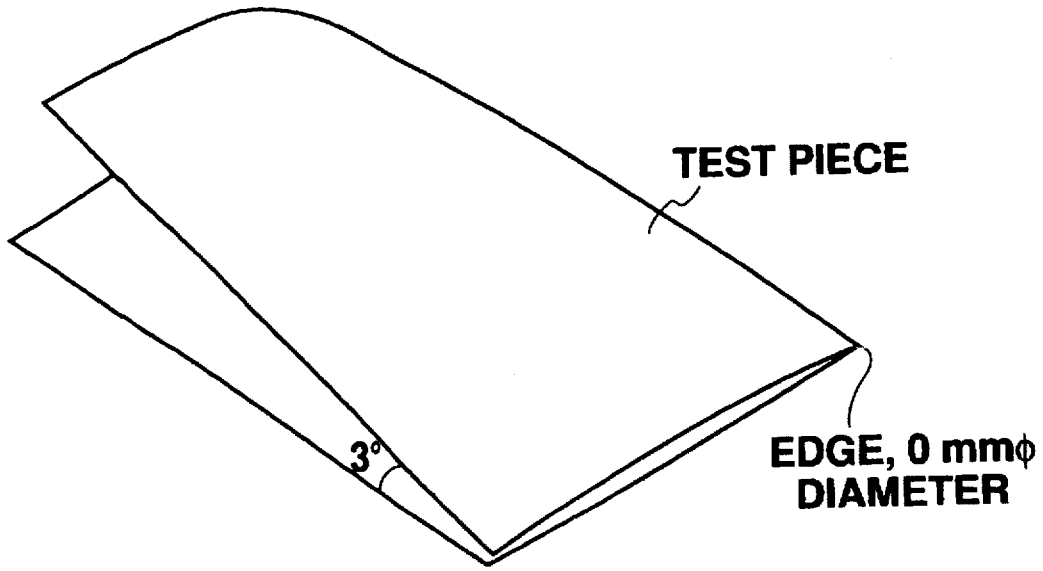
FIG. 1 is a view in perspective showing a bent state of a test piece used in a paint adhesion test.

Next, the invention will be described in further detail with reference to specific examples.

EXAMPLES 1–18 AND COMPARATIVE EXAMPLES 1–6

(1) Object to be Treated

Container without a lid but with adhering lubricating oil and smat obtained by DI process of a 3004 alloy aluminum plate.

(2) Cleaner

Acidic cleaner of "Surfcleaner NHC 250" (Nippon Paint) was used.

(3) Treatment Conditions

The aforesaid container was sprayed with the above cleaner at 75° C. for 60 seconds to remove lubricating oil and smat, and after being rinsed with tap water for 15 seconds, it was sprayed with the treatment solution shown in Table 1 and Table 2. Then, after being rinsed with tap water for 15 seconds and deionized water for 5 seconds, it was dried at 200° C. for 2 minutes.

(4) Cleaning Performance

Tests were carried out on the following items. The results are shown in Table 3.

(a) Blackening on Contact with Boiling Water

Bottom part of container cut out from a surface treated DI container (referred to hereafter as treated can) was immersed in boiling tap water at 100° C. for 30 minutes, and the extent of blackening observed. Blackening was evaluated in the following 5 grades:

| | |
|---|---|
| ⊙ | No blackening |
| ○ | Slight blackening |
| Δ | Some blackening |
| x | Considerable blackening |
| x x | Heavy blackening |

(b) Anti-retort Properties

A treated can was placed in steam at 125° C. obtained by pressurizing tap water in a pressure pot, and the extent of whitening was observed. Whitening was evaluated in the following 5 grades:

| | |
|---|---|
| ⊙ | No whitening |
| ○ | Slight whitening |
| Δ | Some whitening |
| x | Considerable whitening |
| x x | Heavy whitening |

(c) Paint Adhesion

Figure 2:
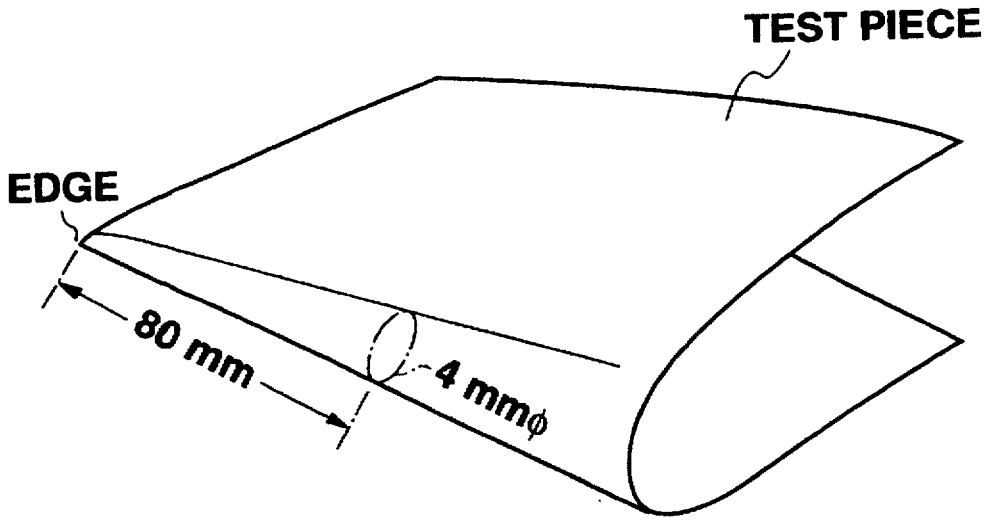
FIG. 2 is a view in perspective showing the bent test piece of FIG. 1 viewed from the rear.
Figure 3:
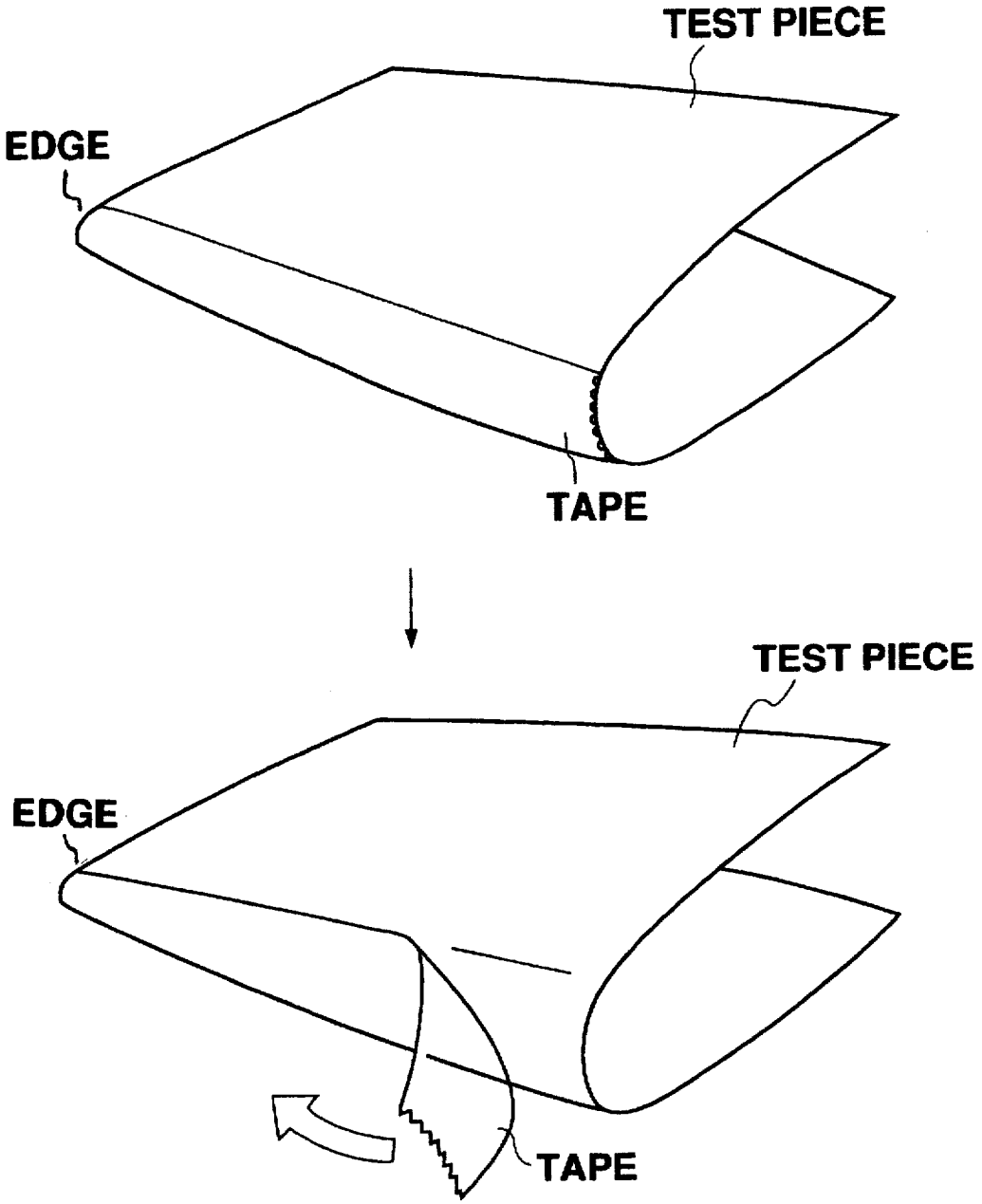
FIG. 3 is a diagram describing a method of testing paint adhesion properties.

A water-based white paint was applied on the external surface of a treated can, then a clear paint (epoxy acrylic clear paint) was applied on top, baked and dried to give a test piece. The paint adhesion was evaluated by the wedge bending method. The test piece was bent to an angle of 3' from a 0 mm diameter edge, as shown in FIG. 1, so that its diameter at 80 mm from this edge was 4 mm (FIG. 2). A tape was put over the bent part as shown in FIG. 3, then the tape was peeled off in the direction of the white arrow in FIG. 3, and the peeled length (mm) of paint film from the edge was measured. If the peeled paint length is shorter, the paint adhesion is better.

The test results are shown below.

TABLE 1

| | | Zirconium salt or titanium salt | | Phosphoric acid or condensed phosphate | | Phosphorous acid or hypophosphorous acid | | Effective fluoride | | | | |
|---|---|---|---|---|---|---|---|---|---|---|---|---|
| | | Type | Concentration (Zr, Ti ppm) | Type | Concentration ($PO_4$, ppm) | Type | Concentration (ppm) | Type | Concentration (ppm) | pH | Treatment temperature (°C.) | Treatment time (seconds) |
| Actual Example | 1 | $H_2ZrF_6$ | 40 | $H_3PO_4$ | 40 | Phosphorous acids | 150 | HF | 10 | 2.8 | 45 | 20 |
| | 2 | $H_2ZrF_6$ | 10 | $H_3PO_4$ | 4Q | As above | 150 | HF | 10 | 2.8 | 50 | 30 |
| | 3 | $H_2ZrF_6$ | 100 | $H_3PO_4$ | 40 | As above | 150 | HF | 10 | 2.8 | 35 | 15 |
| | 4 | $H_2ZrF_6$ | 40 | $H_3PO_4$ | 10 | As above | 150 | HF | 10 | 2.8 | 45 | 20 |
| | 5 | $H_2ZrF_6$ | 40 | $H_3PO_4$ | 100 | As above | 150 | HF | 10 | 2.8 | 45 | 20 |
| | 6 | $H_2ZrF_6$ | 40 | $H_3PO_4$ | 40 | As above | 50 | HF | 10 | 2.8 | 45 | 20 |
| | 7 | $H_2ZrF_6$ | 40 | $H_3PO_4$ | 40 | As above | 500 | HF | 10 | 2.8 | 45 | 20 |
| | 8 | $H_2ZrF_6$ | 40 | $H_3PO_4$ | 40 | As above | 150 | HF | 3 | 2.8 | 45 | 20 |

TABLE 1-continued

| | Zirconium salt or titanium salt | | Phosphoric acid or condensed phosphate | | Phosphorous acid or hypophosphorous acid | | Effective fluoride | | | | |
|---|---|---|---|---|---|---|---|---|---|---|---|
| | Type | Concentration (Zr, Ti ppm) | Type | Concentration ($PO_4$, ppm) | Type | Concentration (ppm) | Type | Concentration (ppm) | pH | Treatment temperature (°C.) | Treatment time (seconds) |
| 9 | $H_2ZrF_6$ | 40 | $H_3PO_4$ | 40 | As above | 150 | HF | 20 | 2.8 | 45 | 20 |
| 10 | $H_2ZrF_6$ | 10 | $H_3PO_4$ | 10 | As above | 50 | HF | 3 | 2.8 | 50 | 30 |
| 11 | $H_2ZrF_6$ | 100 | $H_3PO_4$ | 100 | As above | 500 | HF | 20 | 2.8 | 35 | 15 |
| 12 | $H_2ZrF_4$ | 40 | $H_3PO_4$ | 40 | As above | 150 | HF | 10 | 2.8 | 45 | 20 |
| 13 | $H_2ZrF_6$ | 40 | $H_3PO_4$ | 40 | As above | 150 | HF | 10 | 3.3 | 45 | 20 |
| 14 | $H_2ZrF_6$ | 40 | $H_3PO_4$ | 40 | hypophosphorous acids | 150 | HF | 10 | 2.8 | 45 | 20 |
| 15 | $H_2ZrF_6$ | 40 | $Na_5P_2O_7$ | 40 | Phosphorous acids | 150 | HF | 10 | 2.8 | 45 | 20 |
| 16 | $H_2ZrF_6$ | 40 | $Na_7P_3O_{10}$ | 40 | As above | 150 | HF | 10 | 2.8 | 45 | 20 |
| 17 | $H_2TiF_6$ | 40 | $H_3PO_4$ | 40 | As above | 150 | HF | 10 | 2.8 | 45 | 20 |
| 18 | $H_2ZrF_6$ $h_2TiF_6$ | 20 | $H_3PO_4$ | 40 | As above | 150 | HF | 10 | 2.8 | 45 | 20 |

TABLE 2

| | | Zirconium salt or titanium salt | | Phosphoric acid or condensed phosphate | | Phosphorous acid or hypophosphorous acid | | Effective fluoride | | | | |
|---|---|---|---|---|---|---|---|---|---|---|---|---|
| | | Type | Concentration (Zr, Ti ppm) | Type | Concentration ($PO_4$, ppm) | Type | Concentration (ppm) | Type | Concentration (ppm) | pH | Treatment temperature (°C.) | Treatment time (seconds) |
| Comparison Example | 1 | $H_2ZrF_6$ | 40 | $H_2PO_4$ | 40 | — | — | HF | 10 | 2.8 | 45 | 20 |
| | 2 | $H_2ZrF_6$ | 100 | $H_3PO_4$ | 40 | — | — | HF | 10 | 2.8 | 45 | 20 |
| | 3 | $H_2ZrF_6$ | 40 | $H_3PO_4$ | 100 | — | — | HF | 10 | 2.8 | 45 | 20 |
| | 4 | — | — | $H_2PO_4$ | 40 | Phosphorous acids | 150 | HF | 10 | 2.8 | 45 | 20 |
| | 5 | $H_2ZrF_6$ | 40 | — | — | As above | 150 | HF | 10 | 2.8 | 45 | 20 |
| | 6 | $H_2ZrF_6$ | 40 | $H_3PO_4$ | 40 | As above | 150 | — | — | 2.8 | 45 | 20 |

TABLE 3

| | Blackening on contact with boiling water | Anti-retort properties | Paint adhesion (mm) |
|---|---|---|---|
| Actual Example | | | |
| 1 | ◎ | ◎ | 25 |
| 2 | ◎ | ○ | 21 |
| 3 | ◎ | ◎ | 27 |
| 4 | ◎ | ○ | 22 |
| 5 | ◎ | ◎ | 28 |
| 6 | ◎ | ○ | 22 |
| 7 | ◎ | ◎ | 29 |
| 8 | ◎ | ◎ | 24 |
| 9 | ◎ | ◎ | 25 |
| 10 | ◎ | ○ | 23 |
| 11 | ◎ | ◎ | 30 |
| 12 | ◎ | ◎ | 26 |
| 13 | ◎ | ○ | 24 |
| 14 | ◎ | ◎ | 26 |
| 15 | ◎ | ◎ | 25 |
| 16 | ◎ | ◎ | 26 |
| 17 | ◎ | ◎ | 24 |
| 18 | ◎ | ◎ | 23 |
| Comparative example | | | |
| 1 | ◎ | Δ | 37 |
| 2 | ◎ | ◎ | 50 |
| 3 | ◎ | ◎ | 48 |

TABLE 3-continued

| | Blackening on contact with boiling water | Anti-retort properties | Paint adhesion (mm) |
|---|---|---|---|
| 4 | x x | x x | 22 |
| 5 | x x | x x | 27 |
| 6 | x x | x x | 23 |

As described heretofore, according to the surface treatment composition, surface treatment solution and surface treatment method of this invention, a highly uniform thin coating is formed, hence machining and adhesion properties are far superior to those obtained using conventional techniques, and this protective coating also provides excellent resistance to blackening on contact with boiling water and anti-retort properties.

What is claimed:

1. A surface treatment composition for aluminum and its alloys comprising at least one member selected from the group of phosphoric acid, condensed phosphoric acid or salt of said acids, at a concentration in the range of 10–500 ppm as $PO_4$, at least one member selected from the group of zirconium salt and titanium salt at a concentration in the range of 10–500 ppm as the metal, and effective fluoride, at a concentration in the range of 1–50 ppm as fluorine, further comprising at least one member selected from the group of phosphorous acid, hypophosphorous acid or salts of said acids, at a concentration in the range of 10–5000 ppm as $PO_3$ or hypophosphorous acid.

2. A surface treatment solution for aluminum and its alloys as defined in claim 1, wherein said solution comprises at least one type of phosphoric acid, condensed phosphoric acid or salt of these acids, the concentration of said acids or salts lying in the range 10–100 ppm as $PO_4$, at least one type of zirconium salt or titanium salt, the concentration of said salt lying in the range 10–100 ppm as the metal, effective fluoride, the concentration of said fluoride lying in the range 3–50 ppm as fluorine, and at least one type of phosphorous acid, hypophosphorous acid or salt of said acids, the concentration of said acids or salts lying in the range 50–500 ppm as $PO_3$ or hypophosphorous acid.

3. A surface treatment solution for aluminum and its alloys as defined in claim 1, wherein said solution comprises at least one type of phosphoric acid, condensed phosphoric acid or salt of these acids, the concentration of said acids or salts lying in the range 10–100 ppm as $PO_4$, at least one type of zirconium salt or titanium salt, the concentration of said salt lying in the range 10–100 ppm as the metal, effective fluoride, the concentration of said fluoride lying in the range 3–20 ppm as fluorine, and at least one type of phosphorous acid, hypophosphorous acid or salt of said acids, the concentration of said acids or salts lying in the range 50–500 ppm as $PO_3$ or hypophosphorous acid.

* * * * *